US008646284B2

(12) United States Patent
Ueda

(10) Patent No.: US 8,646,284 B2
(45) Date of Patent: Feb. 11, 2014

(54) HEAT-SOURCE SYSTEM AND METHOD FOR CONTROLLING THE SAME

(75) Inventor: Kenji Ueda, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 375 days.

(21) Appl. No.: 13/146,811

(22) PCT Filed: Mar. 29, 2010

(86) PCT No.: PCT/JP2010/055531
§ 371 (c)(1),
(2), (4) Date: Jul. 28, 2011

(87) PCT Pub. No.: WO2010/113850
PCT Pub. Date: Oct. 7, 2010

(65) Prior Publication Data

US 2011/0283718 A1 Nov. 24, 2011

(30) Foreign Application Priority Data

Mar. 30, 2009 (JP) ..... 2009-083371

(51) Int. Cl.
*F25B 7/00* (2006.01)

(52) U.S. Cl.
USPC ..... 62/79; 62/190; 62/228.1

(58) Field of Classification Search
USPC ..... 62/79, 115, 190, 228.1, 179, 185, 183, 62/129, 126, 157; 165/205, 208, 212; 700/277, 300
See application file for complete search history.

(56) References Cited

U.S. PATENT DOCUMENTS 4,926,649 A * 5/1990 Martinez, Jr. ..... 62/99
5,946,926 A * 9/1999 Hartman ..... 62/201

(Continued)

FOREIGN PATENT DOCUMENTS

CN 2909078 Y 6/2007
JP 10-009796 A 1/1998

(Continued)

OTHER PUBLICATIONS

International Search Report for PCT/JP2010/055531, mailing date of Jun. 8, 2010.

(Continued)

*Primary Examiner* — Mohammad M Ali
(74) *Attorney, Agent, or Firm* — Westerman, Hattori, Daniels & Adrian, LLP

(57) ABSTRACT

A heat-source system includes centrifugal-chillers, cooling-water pumps, cooling towers, cooling-tower fans, chilled-water pumps, and a control unit for controlling them. A plurality of the cooling towers are provided so as to have a cooling-tower capacity corresponding to the total capacity of the rated capacities of the respective centrifugal-chillers, the cooling towers being commonly connected to the plurality of centrifugal-chillers. The control unit preliminarily prepares an optimum cooling-tower capacity relationship representing the cooling-tower capacity with which the heat-source system efficiency, taking into consideration the centrifugal-chillers, the cooling-water pump, the cooling towers, the cooling-tower fan, and the chilled-water pump, is higher, in relation to the outside-air wet-bulb temperature and the centrifugal-chiller partial load factor. The control unit determines the number of cooling towers to be operated by referring to the optimum cooling-tower capacity relationship, on the basis of the outside-air wet-bulb temperature and the partial load factor of the centrifugal-chillers during operation.

6 Claims, 9 Drawing Sheets

(56) References Cited

U.S. PATENT DOCUMENTS

| | | | | |
|---|---|---|---|---|
| 6,185,946 | B1 * | 2/2001 | Hartman | 62/175 |
| 6,405,543 | B2 * | 6/2002 | Kopko | 62/89 |
| 6,532,754 | B2 * | 3/2003 | Haley et al. | 62/129 |
| 6,718,779 | B1 * | 4/2004 | Henry | 62/183 |
| 2003/0000230 | A1 * | 1/2003 | Kopko | 62/82 |
| 2004/0011066 | A1 | 1/2004 | Sugihara et al. | |
| 2005/0103032 | A1 * | 5/2005 | Pierson | 62/175 |
| 2007/0151278 | A1 * | 7/2007 | Jarvis | 62/310 |
| 2007/0261421 | A1 * | 11/2007 | Pierson | 62/175 |
| 2008/0162077 | A1 * | 7/2008 | Chang et al. | 702/182 |
| 2009/0020173 | A1 * | 1/2009 | Lau et al. | 137/565.01 |

FOREIGN PATENT DOCUMENTS

| | | | |
|---|---|---|---|
| JP | 2003-336891 | A | 11/2003 |
| JP | 2004-53127 | A | 2/2004 |
| JP | 2005-114295 | A | 4/2005 |
| JP | 2005-214608 | A | 8/2005 |
| JP | 2005-233557 | A | 9/2005 |
| JP | 2006-038379 | A | 2/2006 |
| JP | 2006-071127 | A | 3/2006 |
| JP | 2006-275323 | A | 10/2006 |
| JP | 2006-275398 | A | 10/2006 |
| JP | 2007-240131 | A | 9/2007 |
| JP | 2007-315695 | A | 12/2007 |
| JP | 2007-333361 | A | 12/2007 |
| JP | 2008-070004 | A | 3/2008 |
| JP | 2008-70067 | A | 3/2008 |
| JP | 2008-134013 | A | 6/2008 |
| JP | 2008-190731 | A | 8/2008 |
| JP | 2009-204262 | A | 9/2009 |

OTHER PUBLICATIONS

Japanese Office Action dated Feb. 26, 2013, issued in corresponding Japanese Patent Application No. 2009-083371, Japanese national entry of PCT/JP2010/055531, w/English translation.

Japanese Office Action dated Feb. 26, 2013, issued in corresponding Japanese Patent Application No. 2009-083371.

Chinese Office Action dated Jul. 31, 2013, issued in corresponding Chinese Patent Application No. 201080009831.5, w/ English translation.

Chinese Office Action dated Jul. 31, 2013, issued in corresponding Chinese Patent Application No. 2010800098315, w/English translation.

Japanese Notification of Grant of Invention Patent dated Oct. 1, 2013, issued in corresponding Japanese Patent Application No. 2009-083371 (3 pages). Explantion of relevancey—"The Decision of Patent Grant has been received.".

* cited by examiner

HEAT-SOURCE SYSTEM AND METHOD FOR CONTROLLING THE SAME

TECHNICAL FIELD

The present invention relates to a heat-source system and a method for controlling the same for improving the efficiency of the overall heat-source system.

BACKGROUND ART

A known heat-source system used to supply chilled water and provide local heating and cooling in semiconductor factories includes a plurality of centrifugal-chillers that can be activated or deactivated according to the quantity of heat required by an external load. The heat-source system includes, besides the centrifugal-chillers, cooling-water pumps for supplying cooling water to condensers of the centrifugal-chillers, cooling towers for cooling the cooling water heated by recovering heat of condensation in the condensers by bringing the cooling water into contact with the outside air, and chilled-water pumps for supplying the chilled water cooled by evaporators of the centrifugal-chillers to the external load. Furthermore, the cooling towers have cooling-tower fans for introducing the outside air into the cooling towers. PTL 1 (described below) discloses an invention related to such a heat-source system, for improving the operating efficiency of the overall heat-source system, taking into consideration not only the chillers alone, but also auxiliary machines, such as the cooling-water pumps, the cooling towers, and the chilled-water pumps. More specifically, a table is formed, with which the COP of the overall heat-source system can be understood from the relationship between the outside-air wet-bulb temperature and the chiller load factor. Next, parameters used in an arithmetic expression which maximizes the COP of the overall heat-source system is determined from the table. Then, based on the result of calculation, the number and output powers of chillers to be operated and the flow rate and temperature of the cooling water are controlled.

CITATION LIST

Patent Literature

{PTL 1}
Japanese Unexamined Patent Application, Publication No. 2008-134013

SUMMARY OF INVENTION

Technical Problem

However, the heat-source system disclosed in PTL 1 is supposed to have a configuration in which the respective cooling towers are independently connected to the respective chillers, as shown in FIG. 1 therein.

Meanwhile, there is a heat-source system including a plurality of cooling towers that are commonly connected to respective centrifugal-chillers. In this heat-source system, when some centrifugal-chillers are stopped, a plurality of cooling towers can be activated so that the cooling-tower capacity is greater than the capacity corresponding to the centrifugal-chillers being operated.

Assuming that, for example, only one centrifugal-chiller is operated. When not only the cooling tower with a capacity corresponding to this centrifugal-chiller, but also another cooling tower is activated, the cooling capacity increases. As a result, the temperature of the cooling water drops. If the temperature of the cooling water drops, the power consumption of the centrifugal-chiller may decrease, which may increase the efficiency. On the other hand, by increasing the number of cooling towers to be activated, the power consumption of the cooling-tower fans increases, which may decrease the efficiency of the overall heat-source system. Alternatively, an increase in the power consumption of the cooling-tower fans may be relatively small, decreasing the power consumption of the centrifugal-chiller, which may increase the efficiency of the overall heat-source system.

As has been described, in the heat-source system including a plurality of cooling towers that are commonly connected to the respective centrifugal-chillers, it is considered that the efficiency of the overall heat-source system can be improved by selecting an appropriate number of cooling towers to be activated.

The present invention has been made in view of the above-described circumstances, and an object thereof is to provide a heat-source system and a method for controlling the same in which the efficiency of the overall heat-source system can be improved by selecting an appropriate number of cooling towers to be activated.

Solution to Problem

In order to solve the above-described problems, the heat-source system and the method for controlling the same of the present invention employ the following solutions.

That is, a heat-source system according to a first aspect of the present invention includes a centrifugal-chiller having a centrifugal-compressor driven by electricity and having a variable rotational frequency, the centrifugal-compressor compressing refrigerant gas, a condenser that condenses the refrigerant gas compressed by the centrifugal-compressor into liquid, an expansion valve that expands the refrigerant condensed into liquid by the condenser, and an evaporator that evaporates the refrigerant expanded by the expansion valve; a cooling-water pump driven by electricity that supplies cooling water for cooling the refrigerant by heat exchange in the condenser; a cooling tower that cools the cooling water guided from the condenser by the cooling-water pump by bringing the cooling water into contact with the outside air to perform heat exchange; a cooling-tower fan driven by electricity and provided on the cooling tower, the cooling-tower fan introducing the outside air into the cooling tower; a chilled-water pump driven by electricity that supplies the chilled water cooled by the heat exchange in the evaporator to an external load side; and a control unit that controls the centrifugal-chiller, the cooling-water pump, the cooling tower, the cooling-tower fan, and the chilled-water pump. A plurality of the centrifugal-chillers are provided. A plurality of the cooling towers are provided so as to have a cooling-tower capacity corresponding to the total capacity of the rated capacities of the respective centrifugal-chillers, the cooling towers being commonly connected to the plurality of centrifugal-chillers. The control unit can change the number of cooling towers to be operated so that the cooling-tower capacity can be changed. The control unit preliminarily stores an optimum cooling-tower capacity relationship representing the cooling-tower capacity of the cooling towers with which the heat-source system efficiency, taking into consideration the centrifugal-chillers, the cooling-water pump, the cooling towers, the cooling-tower fan, and the chilled-water pump, is higher, in relation to the outside-air wet-bulb temperature and the centrifugal-chiller partial load factor. The control unit determines the number of cooling towers to be operated by referring to the optimum cooling-tower capacity relationship, on the basis of the outside-air wet-bulb temperature and the partial load factor of the centrifugal-chillers during operation.

In a heat-source system in which a plurality of cooling towers are commonly connected to a plurality of centrifugal-chillers, cooling towers having a cooling capacity larger than the rated capacity of one centrifugal-chiller can be activated. For example, this state can be realized by operating a plurality of cooling towers while only one centrifugal-chiller is operated. Because the temperature of the cooling water decreases in this state, the power consumption of the centrifugal-chiller may decrease. On the other hand, when a plurality of cooling towers are activated, many cooling-tower fans are activated, which may increase the power consumption of the cooling-tower fans. Accordingly, there is an operating region where the efficiency of the overall heat-source system, taking into consideration the centrifugal-chillers, the cooling-water pumps, the cooling towers, the cooling-tower fans, and the chilled-water pumps, is higher.

The inventor found that there is a cooling-tower capacity of the cooling towers (for example, the number of cooling towers to be activated) with which the heat-source system efficiency is increased, which depends on the outside-air wet-bulb temperature and the centrifugal-chiller partial load factor. Thus, the cooling-tower capacity with which the efficiency of the heat-source system is increased is obtained in advance, in relation to the outside-air wet-bulb temperature and the centrifugal-chiller partial load factor, and operation is performed accordingly. By this, high-efficiency operation of the overall heat-source system can be realized.

Furthermore, because the number of cooling towers to be operated can be determined simply by obtaining the outside-air wet-bulb temperature and the centrifugal-chiller partial load factor, extremely simple operation control can be realized.

For example, a moisture sensor is preferably used to obtain the outside-air wet-bulb temperature. Alternatively, the outside-air wet-bulb temperature may be obtained from the dry-bulb temperature, the relative humidity, and the outside pressure, instead of the moisture sensor.

Furthermore, in the heat-source system according to the first aspect of the present invention, the control unit may determine the number of cooling towers to be operated based on the optimum cooling-tower capacity relationship, such that a first capacity that is larger than the rated capacity of the operating centrifugal-chiller is provided, when the outside-air wet-bulb temperature is equal to or lower than a first predetermined temperature.

As a result of a study of the cooling-tower capacity with which the efficiency of the heat-source system is increased in relation to the outside wet-bulb temperature and the centrifugal-chiller partial load factor, it was found that the efficiency of the overall heat-source system is increased by determining the number of cooling towers to be operated such that the cooling-tower capacity is the first capacity, which is larger than the rated capacity of the operating centrifugal-chiller, when the outside-air wet-bulb temperature is equal to or lower than the first predetermined temperature. Accordingly, high-efficiency operation is realized by performing the above-described heat-source system operation during the winter period and an intermediate period when the outside-air wet-bulb temperature is low.

Note that there is a cooling-tower capacity with which the efficiency of the overall heat-source system is higher, regardless of the centrifugal-chiller partial load factor. If the first predetermined temperature is set as the upper limit value of this state, the number of cooling towers to be operated can be determined based only on the outside-air wet-bulb temperature, independently of the centrifugal-chiller partial load factor. Accordingly, simple operation control is realized.

Furthermore, in the heat-source system having the above-described configuration, the control unit may determine the number of cooling towers to be operated such that an equal capacity, which is equal to the rated capacity of the operating centrifugal-chiller, is provided, when the outside-air wet-bulb temperature is higher than a second predetermined temperature and the centrifugal-chiller partial load factor is equal to or lower than a predetermined load factor.

It was found that the efficiency of the overall heat-source system is increased by determining the number of cooling towers to be operated such that the capacity is equal to the rated capacity of the operating centrifugal-chiller, when the outside-air wet-bulb temperature is higher than the second predetermined temperature and the centrifugal-chiller partial load factor is equal to or lower than the predetermined load factor. Accordingly, high-efficiency operation is realized by performing the above-described heat-source system operation during an intermediate period when the outside-air wet-bulb temperature is relatively high and the quantity of heat required by the external load is small.

Note that, if the "second predetermined temperature" of the above-described configuration is set to the same value as the "first predetermined temperature", which is used as the threshold when the number of cooling towers to be operated is determined so as to provide the first capacity, it is only necessary to change the number of cooling towers using this predetermined temperature as the threshold. Accordingly, simplified operation control is realized.

Furthermore, in the heat-source system having the above-described configuration, the control unit may determine the number of cooling towers to be operated such that a second capacity, which is equal to or lower than the first capacity and is equal to or higher than the equal capacity, is provided, when the outside-air wet-bulb temperature is equal to or higher than the second predetermined temperature and the centrifugal-chiller partial load factor is equal to or higher than the predetermined load factor.

It was found that the efficiency of the overall heat-source system is increased by determining the number of cooling towers to be operated such that the capacity is equal to or lower than the first capacity and is equal to or higher than the equal capacity, when the outside-air wet-bulb temperature is equal to or higher than the second predetermined temperature and the centrifugal-chiller partial load factor is equal to or higher than the predetermined load factor. Accordingly, high-efficiency operation is realized by performing the above-described heat-source system operation during the summer period when the outside-air wet-bulb temperature is relatively high and the quantity of heat required by the external load is large.

Furthermore, when the outside-air wet-bulb temperature is equal to or higher than the second predetermined temperature, it is only necessary to select from the second capacity of the above-described configuration and the equal capacity, using the predetermined load factor as the threshold. Accordingly, simplified operation control is realized.

Note that, if the "second predetermined temperature" of the above-described configuration is set to the same value as the "first predetermined temperature", which is used as the threshold when the number of cooling towers to be operated is determined so as to provide the first capacity, it is only necessary to select one of the three patterns, namely, the equal capacity, the first capacity, and the second capacity of the above-described configuration using the first predetermined temperature (=second predetermined temperature) and the predetermined load factor as the threshold. Accordingly, simplified operation control is realized.

Furthermore, in any of the heat-source systems having the above-described configuration, the control unit may control the flow rate of the cooling-water pump based on the centrifugal-chiller partial load factor, regardless of the outside-air wet-bulb temperature or the number of cooling towers to be operated.

If the flow rate of the cooling-water pumps decreases, the power consumption thereof decreases. Thus, it is expected that the efficiency improves. Conversely, it may be considered that the power consumption of the centrifugal-chiller increases, because the temperature of the cooling water increases. The inventor found that, as a result of a study of the cooling-water flow rate relative to the efficiency of the overall heat-source system, it was found that it is not heavily dependent on the outside-air wet-bulb temperature or the number of cooling towers to be operated, but is heavily dependent on the centrifugal-chiller partial load factor. Therefore, the flow rate of the cooling-water pumps is controlled based on the centrifugal-chiller partial load factor, not the outside-air wet-bulb temperature or the number of cooling towers to be operated. Thus, simplified operation control is realized.

Furthermore, by combining this control with the above-described configurations in which the number of cooling towers to be operated is optimized from the standpoint of the efficiency, the heat-source system can be operated at an even higher efficiency.

Furthermore, a method for controlling a heat-source system according to a second aspect of the present invention includes a centrifugal-chiller having a centrifugal-compressor driven by electricity and having a variable rotational frequency, the centrifugal-compressor compressing refrigerant, a condenser that condenses the refrigerant compressed by the centrifugal-compressor into liquid, an expansion valve that expands the refrigerant condensed into liquid by the condenser, and an evaporator that evaporates the refrigerant expanded by the expansion valve; a cooling-water pump driven by electricity that supplies cooling water for cooling the refrigerant by heat exchange in the condenser; a cooling tower that cools the cooling water guided from the condenser by the cooling-water pump by bringing the cooling water into contact with the outside air to perform heat exchange; a cooling-tower fan driven by electricity and provided on the cooling tower, the cooling-tower fan introducing the outside air into the cooling tower; a chilled-water pump driven by electricity that supplies the chilled water cooled by the heat exchange in the evaporator to an external load side; and a control unit that controls the centrifugal-chiller, the cooling-water pump, the cooling tower, the cooling-tower fan, and the chilled-water pump. A plurality of the centrifugal-chillers are provided. A plurality of the cooling towers are provided so as to have a cooling-tower capacity corresponding to the total capacity of the rated capacities of the respective centrifugal-chillers, the cooling towers being commonly connected to the plurality of centrifugal-chillers. The control unit can change the number of cooling towers to be operated so that the cooling-tower capacity can be changed. The control unit preliminarily stores an optimum cooling-tower capacity relationship representing the cooling-tower capacity of the cooling towers with which the heat-source system efficiency, taking into consideration the centrifugal-chillers, the cooling-water pump, the cooling towers, the cooling-tower fan, and the chilled-water pump, is higher, in relation to the outside-air wet-bulb temperature and the centrifugal-chiller partial load factor. The control unit determines the number of cooling towers to be operated by referring to the optimum cooling-tower capacity relationship, on the basis of the outside-air wet-bulb temperature and the partial load factor of the centrifugal-chillers during operation.

In a heat-source system in which a plurality of cooling towers are commonly connected to a plurality of centrifugal-chillers, cooling towers having a cooling capacity larger than the rated capacity of one centrifugal-chiller can be activated. For example, this state can be realized by operating a plurality of cooling towers while only one centrifugal-chiller is operated. Because the temperature of the cooling water decreases in this state, the power consumption of the centrifugal-chiller may decrease. On the other hand, when a plurality of cooling towers are activated, many cooling-tower fans are activated, which may increase the power consumption of the cooling-tower fans. Accordingly, there is an operating region where the efficiency of the overall heat-source system, taking into consideration the centrifugal-chillers, the cooling-water pumps, the cooling towers, the cooling-tower fans, and the chilled-water pumps, is higher.

The inventor found that there is a cooling-tower capacity of the cooling towers (for example, the number of cooling towers to be activated) with which the heat-source system efficiency is increased, which depends on the outside-air wet-bulb temperature and the centrifugal-chiller partial load factor. Thus, the cooling-tower capacity with which the efficiency of the heat-source system is increased is obtained in advance, in relation to the outside-air wet-bulb temperature and the centrifugal-chiller partial load factor, and operation is performed accordingly. By this, high-efficiency operation of the overall heat-source system can be realized.

Furthermore, because the number of cooling towers to be operated can be determined simply by obtaining the outside-air wet-bulb temperature and the centrifugal-chiller partial load factor, extremely simple operation control can be realized.

For example, a moisture sensor is preferably used to obtain the outside-air wet-bulb temperature. Alternatively, the outside-air wet-bulb temperature may be obtained from the dry-bulb temperature, the relative humidity, and the outside pressure, instead of the moisture sensor.

Advantageous Effects of Invention

The heat-source system and the method for controlling the same according to the present invention provide the following advantages.

The number of cooling towers to be operated is determined based on the relationship that shows the cooling-tower capacity of the cooling tower with which the efficiency of the overall heat-source system is higher, with respect to the outside-air wet-bulb temperature and the centrifugal-chiller partial load factor. Accordingly, an efficient operation of the heat-source system can be achieved by extremely simple operation control.

Furthermore, by reducing the cooling-water flow rate, a more efficient operation of the heat-source system can be achieved.

DESCRIPTION OF EMBODIMENTS

Embodiments of the present invention will be described below with reference to the drawings.

Figure 1:
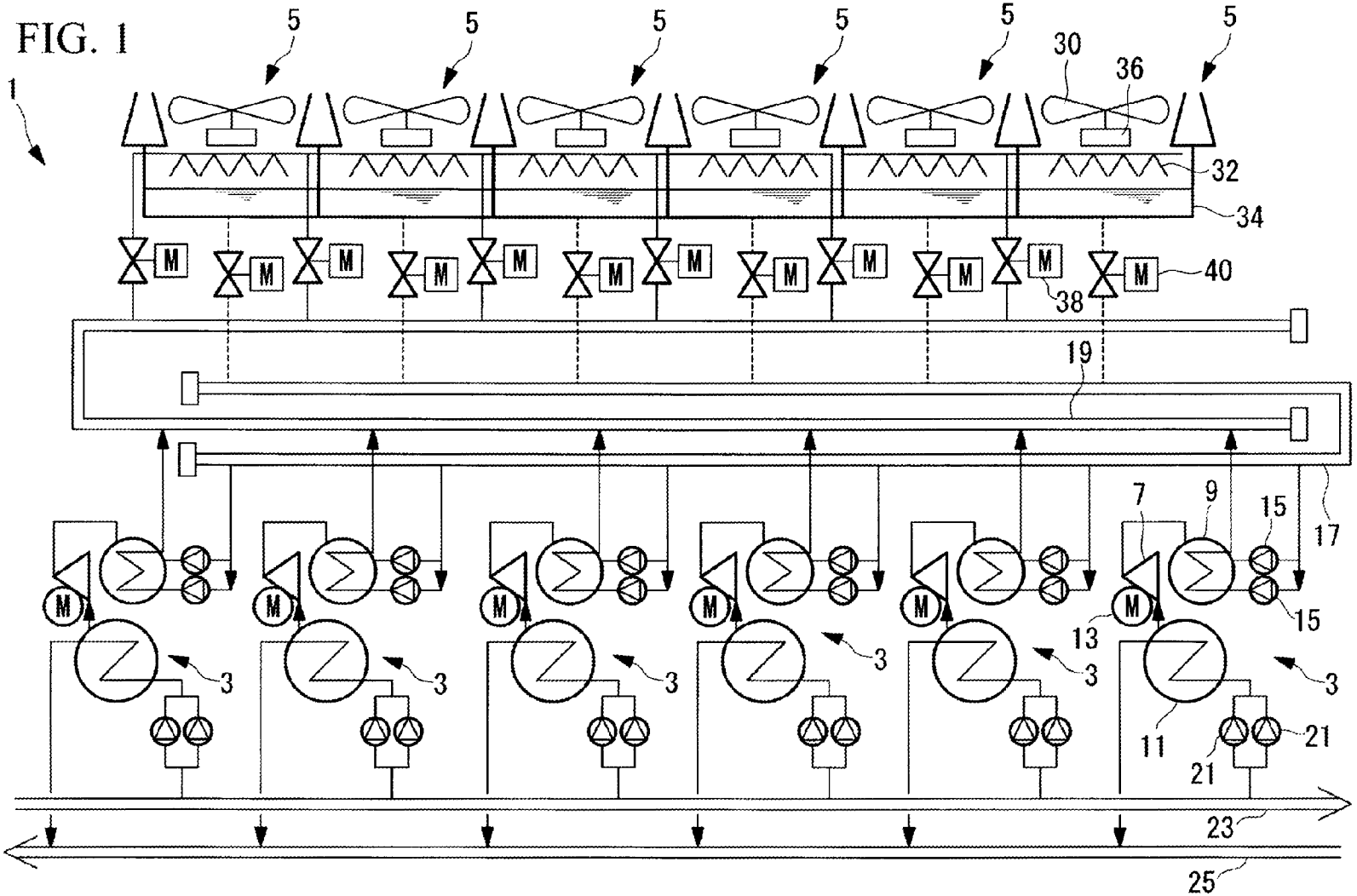
FIG. 1 is a schematic diagram of the configuration of a heat-source system according to an embodiment of the present invention.

FIG. 1 shows a heat-source system according to an embodiment of the present invention. A heat-source system 1 includes a plurality of (six, in this embodiment) centrifugal-chillers 3 arranged in parallel and a plurality of (six, in this embodiment) cooling towers 5 arranged in parallel.

The centrifugal-chillers 3 each include a centrifugal-compressor 7 that compresses refrigerant, a condenser 9 that condenses the refrigerant compressed by the centrifugal-compressor 7 into liquid, an expansion valve (not shown) that expands the refrigerant condensed into liquid by the condenser 9, and an evaporator 11 that evaporates the refrigerant expanded by the expansion valve.

The centrifugal-compressor 7 is driven by an electric motor 13 whose rotational frequency can be varied by an inverter device.

Cooling water supplied by cooling-water pumps 15 is guided to the condenser 9. In this embodiment, two cooling-water pumps 15 arranged in parallel are used, each being driven by an electric motor (not shown) whose rotational frequency can be varied by an inverter device and having a cooling-water-pump switching valve (not shown) that is opened or closed when only one of the cooling-water pumps 15 is operated. Note that one of the cooling-water pumps 15 may be operated at a fixed rate and only the other one may be operated at a variable rate by driving it with an inverter.

Each cooling-water pump 15 takes in cooling water guided from a cooling-water inflow header 17 and discharges the cooling water to the condenser 9 side. The cooling water discharged from the condenser 9 side is guided to a cooling-water outflow header 19. All the centrifugal-chillers 3 and all the cooling towers 5 are commonly connected to the cooling-water inflow header 17. All the centrifugal-chillers 3 and all the cooling towers 5 are also commonly connected to the cooling-water outflow header 19.

Chilled water supplied by chilled-water pumps 21 is guided to the evaporator 11. In this embodiment, two chilled-water pumps 21 arranged in parallel are used, each being driven by an electric motor (not shown) whose rotational frequency can be varied by an inverter device and having a chilled-water-pump switching valve (not shown) that is opened or closed when only one of the chilled-water pumps 21 is operated. Note that one of the chilled-water pumps 21 may be operated at a fixed rate and only the other one may be operated at a variable rate by driving it with an inverter.

Each chilled-water pump 21 takes in guided chilled water from a chilled-water inflow header 23 and discharges the chilled water to the evaporator 11 side. The chilled water discharged from the evaporator 11 side is guided to a chilled-water outflow header 25. All the centrifugal-chillers 3 are commonly connected to the chilled-water inflow header 23. All the centrifugal-chillers 3 are also commonly connected to the chilled-water outflow header 25.

The chilled-water inflow header 23 and the chilled-water outflow header 25 are connected to an external load (not shown). Chilled water (at a temperature of, for example, 7° C.) cooled by the evaporator 11 is supplied to the external load via the chilled-water outflow header 25, and the chilled water (at a temperature of, for example, 12° C.) used and heated by the external load is returned to the evaporator 11 side via the chilled-water inflow header 23.

The cooling tower 5 includes a cooling-tower fan 30, a sprinkler header 32, and a cooling-water reservoir tank 34.

The cooling-tower fan 30 is used to introduce the outside air into the cooling tower 5 and is driven by an electric motor 36. An electric motor whose rotational frequency can be varied by an inverter device may be suitably used as this electric motor 36.

A sprinkler header 32 sprays cooling water from above, allowing the cooling water to flow down a filler (not shown), which has a large surface area and is disposed below the sprinkler header 32, so that the cooling water comes into contact with the outside air, thereby cooling the cooling water utilizing not only sensible heat, but also latent heat of vaporization. A cooling-water outflow on-off valve 38 is provided between the sprinkler header 32 and the cooling-water outflow header 19.

Cooled cooling water, which has been sprayed and cooled by the outside air, is collected in the cooling-water reservoir tank 34. The cooling water collected in the cooling-water reservoir tank 34 is guided to the cooling-water inflow header 17 via a cooling-water inflow on-off valve 40.

The cooling tower 5 is activated or deactivated by opening or closing the cooling-water outflow on-off valve 38 and the cooling-water inflow on-off valve 40. Thus, the number of cooling towers 5 to be activated can be changed.

The cooling tower 5 has a moisture sensor (not shown). The outside-air wet-bulb temperature can be obtained with this moisture sensor. The output of the moisture sensor is directed to a control unit (described below). Note that the outside-air wet-bulb temperature may be obtained from the dry-bulb temperature, the relative humidity, and the outside pressure, instead of the moisture sensor.

The heat-source system includes the control unit (not shown), which controls the operation of the centrifugal-chillers 3, cooling-water pumps 15, cooling-tower fans 30, cooling-water outflow on-off valves 38, cooling-water inflow on-off valves 40, chilled-water pumps 21, chilled-water-pump switching valves (not shown), and cooling-water-pump switching valves (not shown).

The total rated capacity of all the centrifugal-chillers 3 and the total rated capacity of all the cooling towers 5 are equal. For example, when three of the six centrifugal-chillers have a rated capacity of 370 Rt and the remaining three have a rated capacity of 750 Rt, three of the six cooling towers have a rated capacity of 370 Rt and the remaining three have a rated capacity of 750 Rt. Note that, as long as their total rated capacities are equal, it is not necessary that each centrifugal-chiller has the same rated capacity as the corresponding cooling tower.

Figure 2:
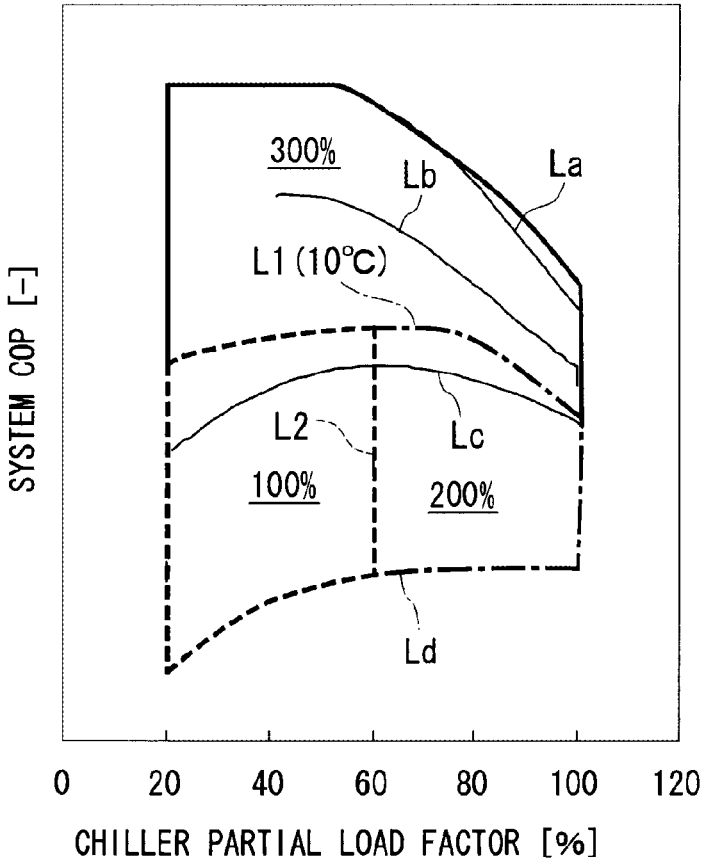
FIG. 2 is a conceptual diagram showing an optimum cooling-tower capacity in relation to the outside-air wet-bulb temperature and the centrifugal-chiller partial load factor, which is stored in a control unit as a map.
Figure 3:
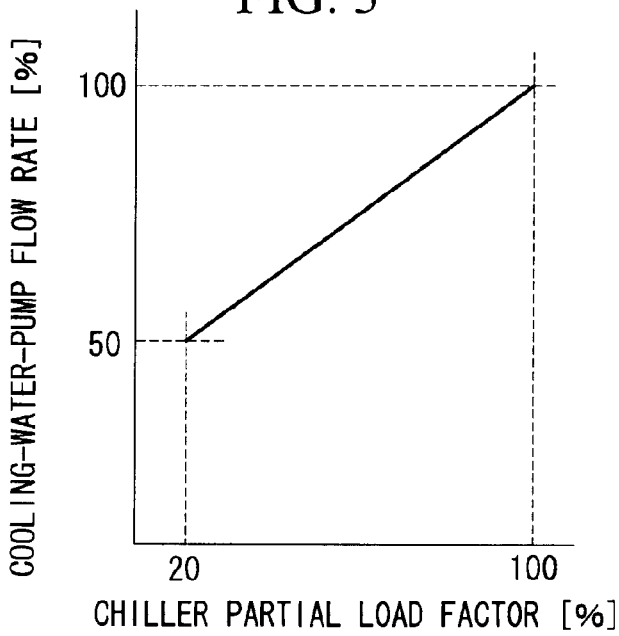
FIG. 3 is a conceptual diagram showing the relationship between an optimum cooling-water-pump flow rate and the centrifugal-chiller partial load factor, which is stored in the control unit.

The control unit stores a map or a relational expression, as shown in FIGS. 2 and 3, in its storage area.

In FIG. 2, the horizontal axis shows the centrifugal-chiller partial load factor, and the vertical axis shows the system COP, which represents the efficiency of the overall heat-source system. This map (optimum cooling-tower capacity relationship) shows the most efficient cooling-tower capacities of the cooling towers 5 in the overall heat-source system, in relation to the centrifugal-chiller partial load factor and the outside-air wet-bulb temperature.

A curve L1 in the figure indicates the outside-air wet-bulb temperature serving as a threshold (first temperature). When the outside-air wet-bulb temperature is lower than this outside-air wet-bulb temperature, a cooling-tower capacity of 300% is the most efficient (the upper region in the figure). Herein, "a cooling-tower capacity of 300%" means a cooling-tower capacity that is three times (300%) the total rated capacity of the activated centrifugal-chillers 3.

A line L2 in the figure indicates the centrifugal-chiller partial load factor serving as a threshold (the predetermined load factor). When the load factor is lower than this load factor, a cooling-tower capacity of 100% is the most efficient (the lower left region in the figure). Furthermore, when the load factor is higher than this load factor, a cooling-tower capacity of 200% is the maximum (the lower right region in the figure).

In the figure, isothermal lines La, Lb, Lc, and Ld of the outside-air wet-bulb temperature are shown for reference. The outside-air wet-bulb temperature increases in the sequence of La, Lb, L1, Lc, and Ld.

FIG. 3 shows the relationship between the flow rate of the cooling-water pumps 15 and the centrifugal-chiller partial load factor. A cooling-water-pump flow rate of 100% is the rated flow rate.

As shown in the figure, the control unit controls the cooling-water-pump flow rate based only on the centrifugal-chiller partial load factor, regardless of the outside-air wet-bulb temperature or the number of cooling towers 5 being operated.

Furthermore, as shown in the figure, by expressing the cooling-water-pump flow rate and the centrifugal-chiller partial load factor as a first-order linear relationship, control becomes extremely simple.

Next, using FIG. 4, the above-described method for controlling the heat-source system will be described.

First, in step S1, the load and the outside-air conditions are obtained. More specifically, the control unit obtains the chilled-water inlet temperature of the chilled water flowing into the evaporator 11 and the chilled-water outlet temperature of the chilled water flowing out of the evaporator 11 using temperature sensors. Then, the flow rate of the chilled water supplied by the chilled-water pumps 21 is obtained by a flowmeter. The control unit calculates the load consumed by the external load by multiplying the chilled-water inlet-outlet temperature difference obtained by the temperature sensors, the flow rate of the chilled water, the specific heat of the chilled water, and the specific weight of the chilled water. Furthermore, the control unit obtains the outside-air wet-bulb temperature from the moisture sensor provided on the cooling tower 5.

Next, in step S2, the number of the centrifugal-chillers 3 being operated is determined such that the chilled-water inlet temperature is equal to or lower than a predetermined value, which is the conventional operation method (1); or such, that the chilled-water inlet temperature can be maintained at or below a predetermined value and such that the COP of the centrifugal-chillers alone is the maximum, (2) (the "maximum COP operation" as used herein means an operation in which the number of the chillers to be operated is determined using the operation method disclosed in Japanese Unexamined Patent Application, Publication No. 2009-204262). As has been described, in this embodiment, the number of centrifugal-chillers 3 to be activated is determined for the centrifugal-chillers alone, independently of the number of the cooling towers 5 to be activated.

In step S3, the flow rate of the chilled-water pumps 21 is controlled.

The flow rate of the chilled water in the chilled-water pumps 21 is determined according to the chilled water demand of the external load. At this time, as in step S4, by reducing the flow rate of the chilled-water pumps 21 to the maximum extent as long as the chilled water demand is met, the power consumption of the chilled-water pumps 21 is reduced as much as possible. The flow rate of the chilled water is reduced by reducing the rotational frequency of the electric motors that drive the chilled-water pumps 21, using inverter devices. The chilled water demand of the external load may be obtained either as the required amount of chilled water or as the pressure difference between the chilled-water outflow header 25 and the chilled-water inflow header 23, by which the necessary water can be delivered.

In step S5, the flow rate of the cooling-water pumps 15 is controlled.

The flow rate of the cooling-water pumps 15 can be obtained in step S6 from a preliminarily obtained relational expression, as shown in FIG. 3. This relational expression is described as a linear function with respect to the centrifugal-chiller partial load factor and is stored in the storage area of the control unit. More specifically, when the rated cooling-water inlet-outlet temperature difference is 5° C., control is performed such that the cooling-water flow rate is 100% at a centrifugal-chiller partial load factor of 100% (rated value) and such that the cooling-water flow rate is 50% at a centrifugal-chiller partial load factor of 20%, which is the minimum; that is, such that the cooling-water flow rate monotonically decreases as the centrifugal-chiller partial load factor decreases. In this manner, the flow rate of the cooling-water pumps 15 is controlled separately and independently of the number of cooling towers.

In step S7, the number of the cooling towers 5 to be activated is determined.

When the outside-air wet-bulb temperature is lower than 10° C., the required capacity for the cooling towers 5, QCTd, is set to 300% (step S8). In this case, the upper region above the curve L1 in the map shown in FIG. 2 is required. Herein, the required capacity QCTd means the cooling-tower capacity required when the cooling tower capacity corresponding to the rated capacity of one operating centrifugal-chiller 3 is 100%. Accordingly, a QCTd of 300% means requiring a cooling-tower capacity that is three times the rated capacity of one operating centrifugal-chiller 3 to the cooling towers.

When the outside-air wet-bulb temperature is equal to or higher than 10° C., and the centrifugal-chiller partial load factor is 60% or more, the required capacity for the cooling towers 5, QCTd, is set 200% (step S8). In this case, the lower right region below the curve L1 and to the right of the line L2 in the map shown in FIG. 2 is required.

When the outside-air wet-bulb temperature is equal to or higher than 10° C., and the centrifugal-chiller partial load factor is lower than 60%, the required capacity for the cooling towers 5, QCTd, is set 100% (step S8). In this case, the lower left region below the curve L1 and to the left of the L2 in the map shown in FIG. 2 is required.

Next, the process proceeds to step S9, where the total required capacity ΣQCTd is calculated, which is the sum of the required capacities for the cooling towers 5 required by the respective operating centrifugal-chillers 3. When the total required capacity ΣQCTd is equal to or lower than the total capacity of installed cooling towers ΣQCTi, which is the total capacity of the cooling towers installed (the total capacity of all the cooling towers 5 in the heat-source system 1), the process proceeds to step S10, where the required capacity for the cooling towers required in step S8 is employed.

On the other hand, when the total required capacity ΣQCTd exceeds the total capacity of installed cooling towers ΣQCTi, the process proceeds to step S11, where the total required capacity ΣQCTd is corrected so as to conform to the total capacity of installed cooling towers ΣQCTi. The cooling-tower capacity QCTd' that can be required by each operating centrifugal-chiller 3 is the value obtained by dividing the total capacity of installed cooling towers ΣQCTi by the number of the operating centrifugal-chillers 3, N (step S12).

Next, a method for acquiring the map and the relational expression shown in FIGS. 2 and 3 will be described below. The method described below is performed by simulation.

The heat-source system COP, which shows the efficiency of the overall heat-source system 1, is obtained by dividing the quantity of heat, which is obtained by subtracting the thermal input of the chilled-water pump from the quantity of heat output from the centrifugal-chiller, by the sum of the energy consumptions of the centrifugal-chillers, chilled-water pumps, cooling-water pumps, and cooling-tower fans, as shown in Expression 1.

{Expression 1}

$$COP_{sys}=\{Q_{tb}-\eta_{mp}P_{chp}\}/\{P_{tb}+P_{chp}+P_{clp}+P_{ct}\} \quad (1)$$

where $Q_{tb}$: cooling output of the centrifugal-chiller [kW]

$P_{tb}$: energy consumption of the centrifugal-chiller [kW]

$P_{chp}$: energy consumption of the chilled-water pump [kW]

$P_{clp}$: energy consumption of the cooling-water pump [kW]

$P_{ct}$: power consumption of the cooling-tower (corresponding to fan power) [kW]

$\eta_{mp}$: efficiency of the motor for the pump [−]

Theoretical Expressions of the energy consumption of the respective components will be shown below.

(i) Thermal Output of Heat-Source System

Because the chilled-water pump gives the chilled water a heat input of $\eta_{mp}\cdot P_{chp}$, the thermal output of the heat-source system is subtraction of $\eta_{imp}\cdot P_{chp}$ from the thermal output of the centrifugal-chiller, $Q_{tb}$. Note that the quantity of remaining heat of the chilled-water pump, $(1-\eta_{mp})\cdot P_{chp}$, is released into the air.

(ii) Energy Consumption of Centrifugal-Chiller

The energy consumption $P_{tb}$ is calculated by dividing the thermal output of the centrifugal-chiller, $Q_{tb}$, by $COP_{tb}$, which is obtained from the temperature of the cooling water, the centrifugal-chiller partial load factor, and the performance characteristics.

(iii) Energy Consumption of Chilled-Water Pump $P_{chp}$ and Energy Consumption of Cooling-Water Pump $P_{clp}$ Assuming that the discharge rate of the pump is Q[$m^3$/s], the net pump head is H[m], the density of pumped liquid is ρ[kg/$m^3$], and the acceleration of gravity is g[m/$s^2$], the motive power Pw[kW] applied to the liquid by the pump is expressed as Expression 2.

{Expression 2}

$$P_w=\rho gQ(i)[H_{ev}+\{Q(i)/Q_{rp}\}^2H_r]/10^3 \quad (2)$$

$$H=H_{ev}+H_r \quad (2.1)$$

As shown in Expression (2.1), the net pump head H[m] is the sum of height direction $H_{ev}$ and pump head $H_r$, which corresponds to the flow resistance. Note that the subscript "rp" means "rated".

When $P_w$ is the water power, and the pump efficiency is $\eta_p$, the shaft power P[kW] of the pump is expressed as Expression 3.

{Expression 3}

$$P=P_w/\eta_p \quad (3)$$

$$P_{clp}=P/\eta_{mp} \quad (3.1)$$

$$P_{chp}=P/\eta_{mp} \quad (3.2)$$

(iv) Energy Consumption of Cooling-Tower Fan

The power consumption of the cooling-tower fan $P_{ct}$[kW] is expressed as Expression 4. The power consumption of the rotational-speed-controlled cooling-tower fans is proportional to the cube of the airflow rate, and the airflow rate is proportional to the square of the rotational speed of the fans. Because typical open-type cooling towers have fans at the top of the towers, the amount of cooling water evaporated and released into the air is taken into consideration. In Expression 4, to simplify the calculation, a method is employed in which the specific volume of the air is used as the intake conditions of the cooling towers and the amount of evaporated water is added. In the rated conditions, a dry-bulb temperature is 35° C., a wet-bulb temperature is 27° C., and the amount of evaporated water is taken into consideration from the quantity of exhaust heat.

{Expression 4}

$$P_{ct}(i)=P_{ct}(rp)\{(q_{mi}(i)+q_{ml}(i))/q_{mR}\}^3 \quad (4)$$

$P_{ct}$(rp): rated power consumption of cooling-tower fan [kW]

$q_{mR}$: $q_{mR}=q_{mi}(rp)+q_{ml}(rp)$, rated air mass flow rate of cooling tower [kg/h]

$q_{mi}$(i): actual air mass flow rate of cooling tower [kg/h]

$q_{ml}$(i): amount of evaporated cooling water [kg/h]

Increase in Cooling-Tower Capacity

Figure 5:
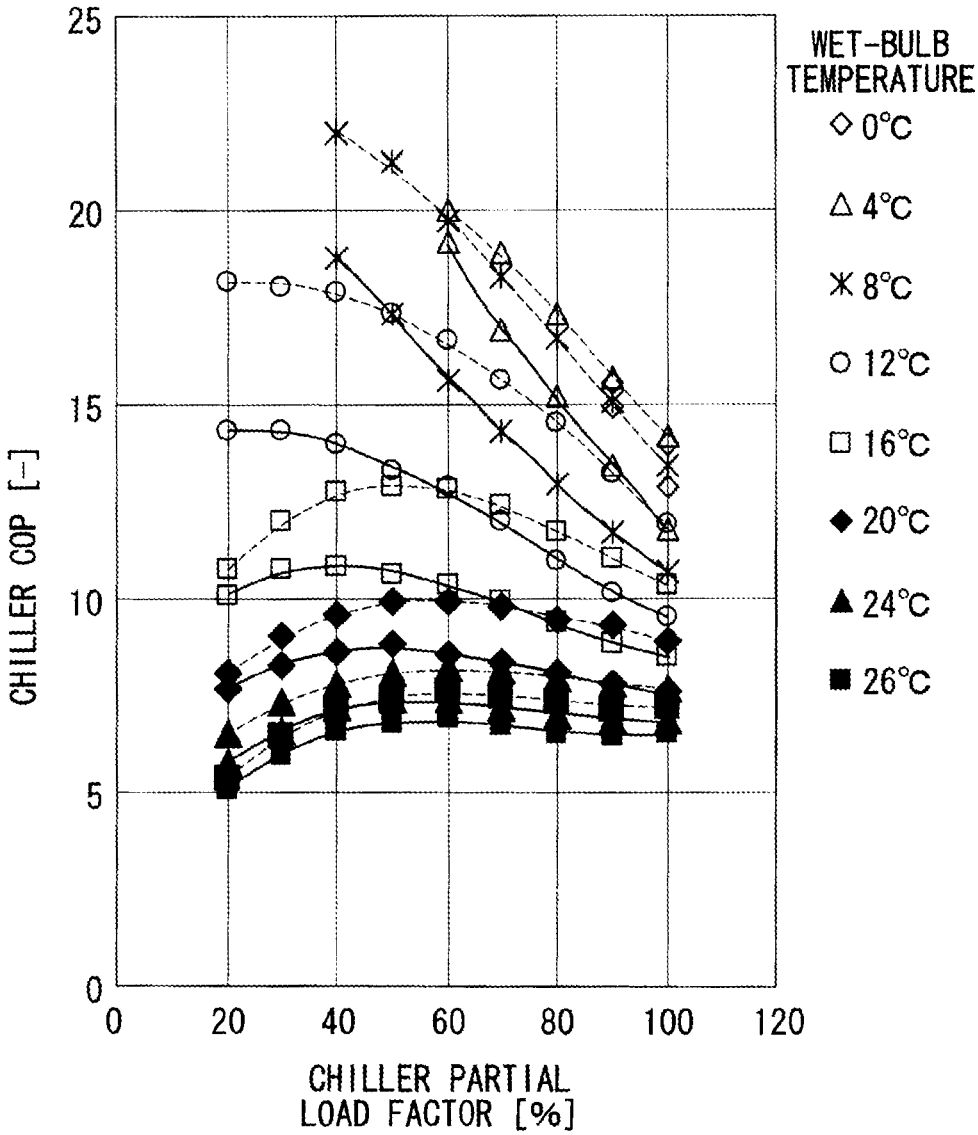
FIG. 5 is a graph showing simulation results of the COP of the centrifugal-chillers alone versus the centrifugal-chiller partial load factor, for cooling tower capacities of 100% and 300%.

FIG. 5 shows simulation results of the chiller COP, which shows the efficiency of the centrifugal-chillers alone, the simulation being performed under the above-described conditions. In FIG. 5, the horizontal axis represents the centrifugal-chiller partial load factor. The results are plotted for respective outside-air wet-bulb temperatures. The solid lines show the cooling-tower capacity of 100%, and the dashed lines show the cooling-tower capacity of 300%.

As the cooling-tower capacity increases from 100% to 300%, the chiller COP increases at all the wet-bulb temperatures. However, the improvement in the chiller COP is small in a region where the load factor is low, i.e., about 20% to 40%.

Figure 6:
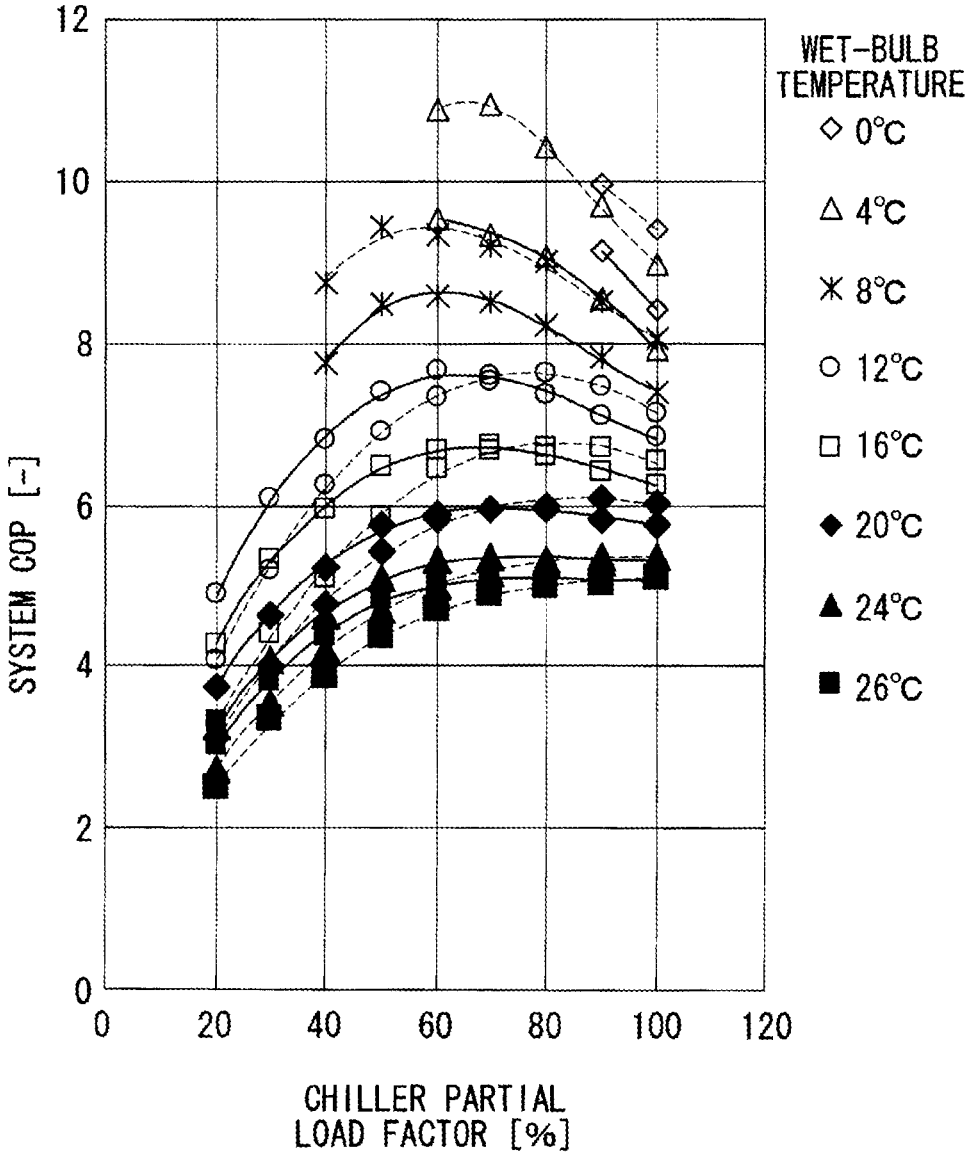
FIG. 6 is a graph showing simulation results of the COP of the overall heat-source system versus the centrifugal-chiller partial load factor, for cooling tower capacities of 100% and 300%.

FIG. 6 shows simulation results of the system COP, which shows the efficiency of the heat-source system 1, the simulation being performed under the same conditions as FIG. 5. Similarly to FIG. 5, the solid lines show the cooling-tower capacity of 100%, and the dashed lines show the cooling-tower capacity of 300%.

When the outside-air wet-bulb temperature is 8° C. or less, as the cooling-tower capacity increases from 100% to 300%, the system COP increases for all the centrifugal-chiller partial load factors. However, when the outside-air wet-bulb temperature is 12° C. or more, the COP is high with a cooling-tower capacity of 300% in a region where the centrifugal-chiller partial load factor is high, whereas, conversely, the COP is high with a cooling-tower capacity of 100% in a region where the centrifugal-chiller partial load factor is low. In this manner, the centrifugal-chiller partial load factor with which the relationship between the system COP with a cooling-tower capacity of 300% and the system COP with a cooling-tower capacity of 100% is inverted moves to a higher load side as the outside-air wet-bulb temperature increases.

Figure 7:
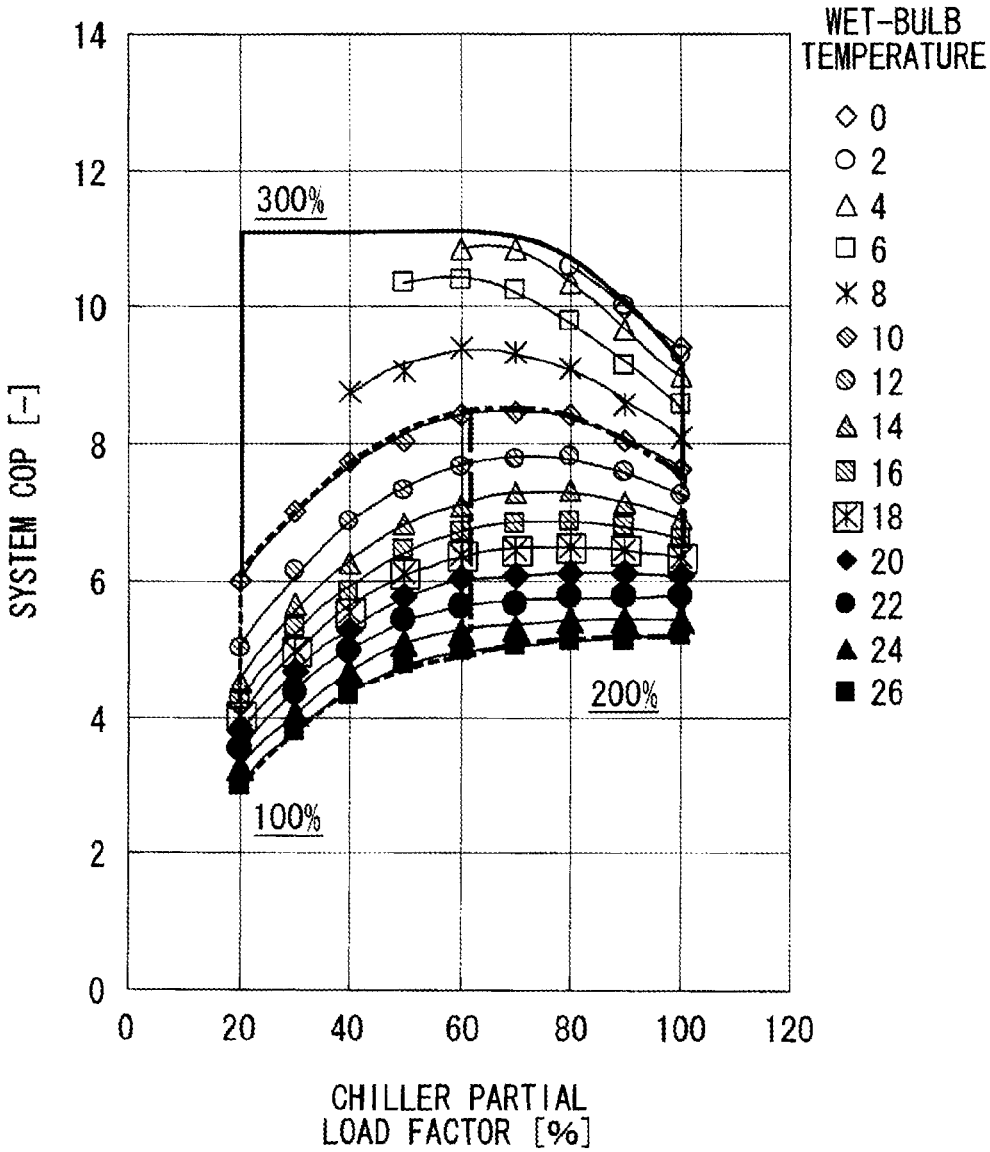
FIG. 7 is a graph showing regions in which the COP of the overall heat-source system is maximum, for cooling tower capacities of 100%, 200%, and 300%.

As can be seen from the relationship between FIGS. 5 and 6, when the efficiency of the overall heat-source system, not just the efficiency of the centrifugal-chillers alone, are taken into consideration, as shown in FIG. 6, an optimum value of the cooling-tower capacity can be obtained in relation to the outside-air wet-bulb temperature and the centrifugal-chiller partial load factor. Now, a simulation for a case where the cooling-tower capacity is 200% is performed, and regions of the cooling-tower capacity in which the COP is the maximum are shown in FIG. 7.

As shown in the figure, when the outside-air wet-bulb temperature is lower than 8° C., the maximum COP occurs with a cooling-tower capacity of 300%, regardless of the centrifugal-chiller partial load factor. Furthermore, in a region where the outside-air wet-bulb temperature is higher than 8° C., a good COP occurs with a cooling-tower capacity of 200% in a region where the chiller load factor is higher than 60%, and the maximum COP occurs with a cooling-tower capacity of 100% in a region where the chiller load factor is equal to or lower than 60%.

Accordingly, during the winter period and an intermediate period when the outside-air wet-bulb temperature is low, the energy saving effect can be obtained by increasing the cooling-tower capacity to 300%, regardless of the centrifugal-chiller partial load factor. However, when the outside-air wet-bulb temperature is high and in a region where the centrifugal-chiller partial load factor is low, no advantage can be obtained from an increase in the cooling-tower capacity. Furthermore, because the advantage due to an increase in the cooling-tower capacity may be obtained in a region where the chiller load factor is higher than a certain level, under conditions in which the wet-bulb temperature is high, such as in the summer period, it can be said that a moderate cooling-tower capacity of 200% is suitable.

Reduction in Cooling-Water Flow Rate

Figure 8:
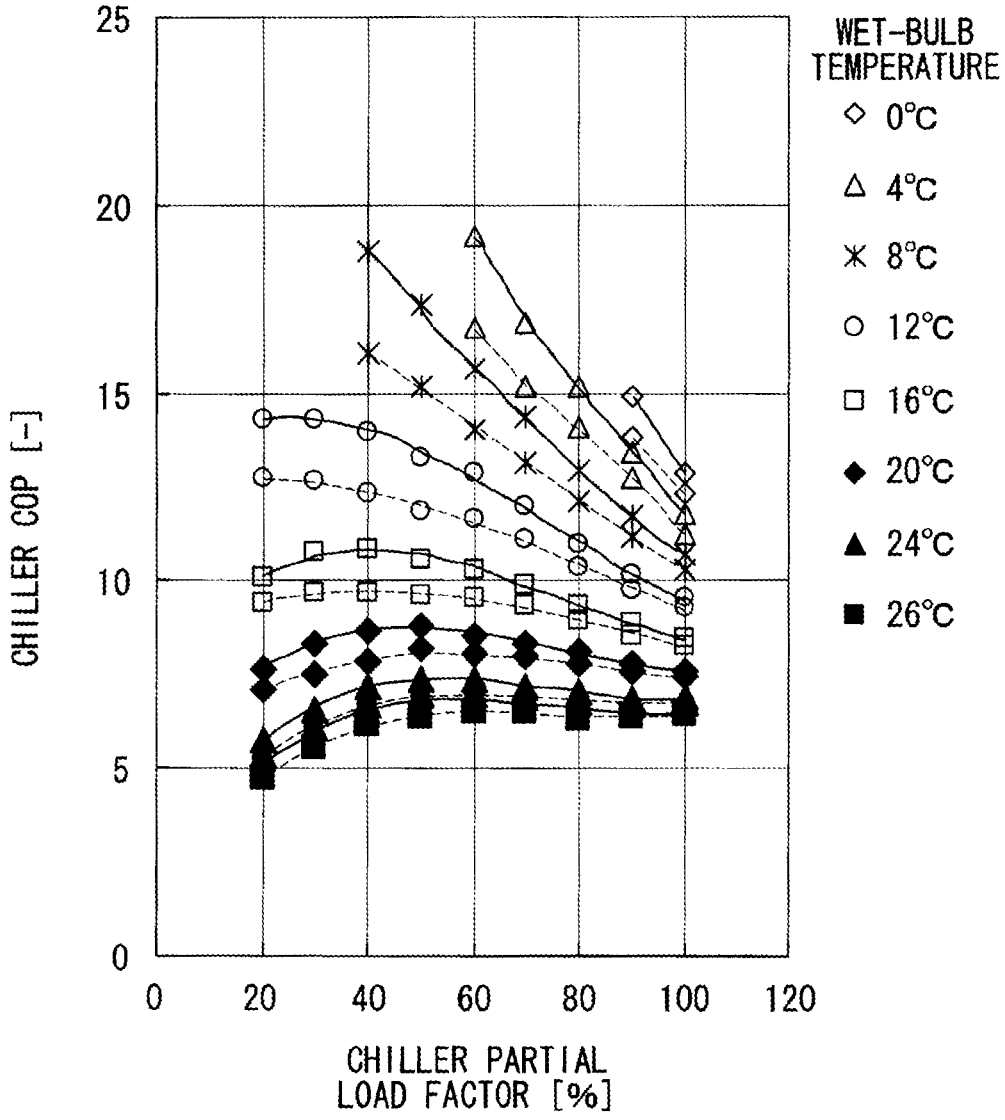
FIG. 8 is a graph of simulation results of the COP of the centrifugal-chillers alone when the cooling-water flow rate is reduced, versus the centrifugal-chiller partial load factor.

FIG. 8 shows simulation results of the chiller COP, which shows the efficiency of the centrifugal-chillers alone, when the specified rated cooling-water inlet-outlet temperature difference is 5° C. and when the cooling-water flow rate is reduced from the rated value flow rate, 100%. In FIG. 8, the horizontal axis represents the centrifugal-chiller partial load factor. The results are plotted for respective outside-air wet-bulb temperatures. The solid lines show the cases where the cooling-water flow rate is not reduced (i.e., the cooling-water flow rate is 100%), and the dashed lines show the chiller COPs occurring at the cooling-water flow rates at which the chiller COP is maximized, for cases where the cooling-water flow rate is reduced from 100% in decrements of 5%.

As can be seen from the figure, the chiller COP decreases at all the outside-air wet-bulb temperatures and all the centrifugal-chiller partial load factors. This is thought to be because the reduced cooling-water flow rate raises the temperature of the cooling water, increasing the power consumption of the centrifugal-chillers.

Figure 9:
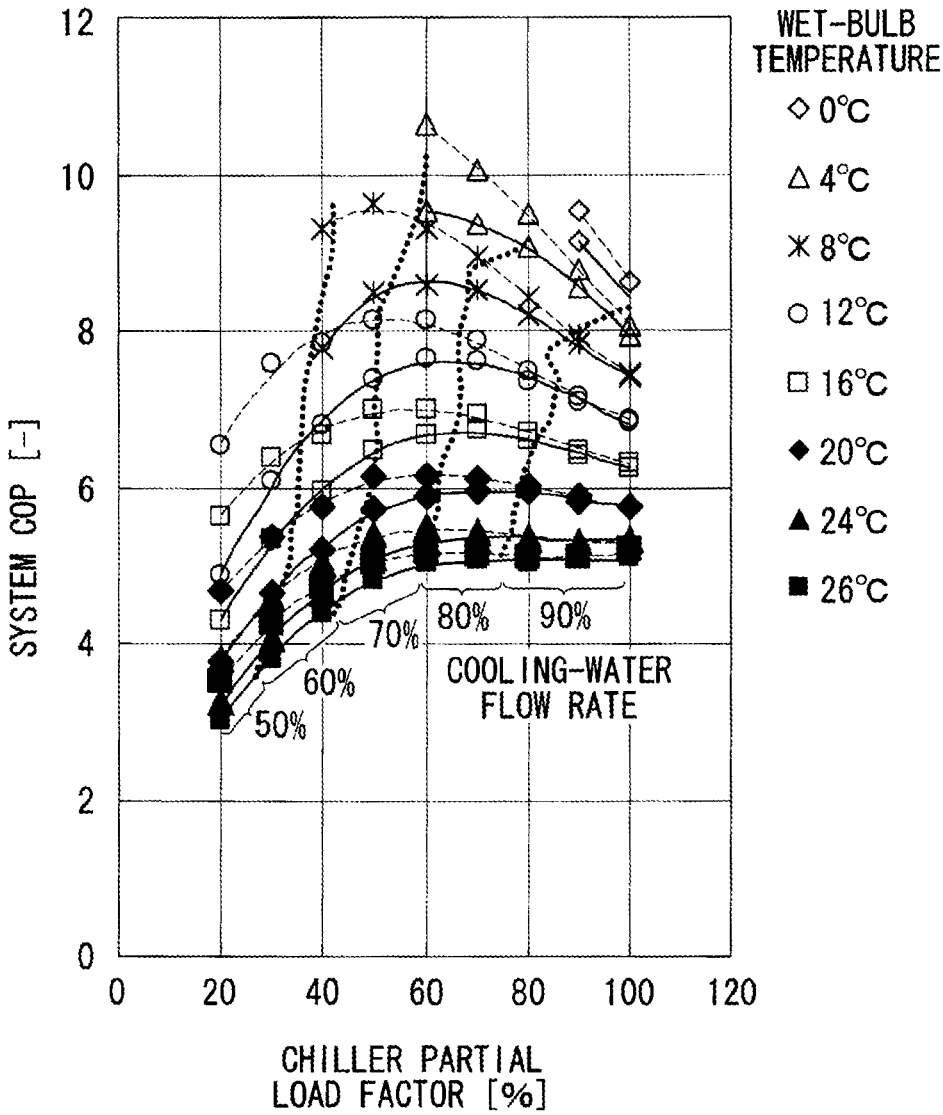
FIG. 9 is a graph of simulation results of the COP of the overall heat-source system when the cooling-water flow rate is reduced, versus the centrifugal-chiller partial load factor.

FIG. 9 shows simulation results of the system COP, which shows the efficiency of the heat-source system 1, the simulation being performed under the same conditions as FIG. 8. Similarly to FIG. 8, the solid lines show the cases where the cooling-water flow rate is not reduced, and the dashed lines show the system COPs occurring at the cooling-water flow rates at which the system COP is maximized, for cases where the cooling-water flow rate is reduced from 100% in decrements of 5%.

Furthermore, the figure shows regions of the cooling-water flow rate, defined by dotted lines, where the maximum system COP occurs when the cooling-water flow rate is reduced. That is, in regions where the centrifugal-chiller partial load factor is high, the maximum system COP occurs at a cooling-water flow rate of 90%. As the centrifugal-chiller partial load factor decreases, the cooling-water flow rate at which the efficiency is maximized decreases, from 80% to 70% to 60% and to 50%.

As can be seen from the figure, the system COP is improved at all the outside-air wet-bulb temperatures and all the centrifugal-chiller partial load factors. This means that the system COP increases despite a decrease in the chiller COP due to a reduction in the cooling-water flow rate (see FIG. 8), which is a new finding.

The cooling-water flow rate at which the maximum system COP occurs decreases as the centrifugal-chiller partial load factor decreases. At the minimum centrifugal-chiller partial load factor, 20%, the cooling-water flow rate is the minimum, 50%. As a result of a further study of the relationship between the cooling-water flow rate and the centrifugal-chiller partial load factor, it was found that the influence of the outside-air wet-bulb temperature on the cooling-water flow rate relative to the centrifugal-chiller partial load factor is about 10%, which is not significant. Furthermore, the minimum cooling-water flow rate is 50%, independent of the outside-air wet-bulb temperature. Accordingly, it was found that expressing the cooling-water flow rate as a first order expression only in relation to the centrifugal-chiller partial load factor, as shown in FIG. 3, is sufficient. Of course, a method for narrowing the 10% error range of the cooling-water flow rate may be employed, taking into consideration the outside-air wet-bulb temperature. However, from the standpoint of simple control, it is preferable to define the cooling-water flow rate simply in relation to the centrifugal-chiller partial load factor, as shown in FIG. 3.

Increase in Cooling-Tower Capacity and Reduction in Cooling-Water Flow Rate

Figure 10:
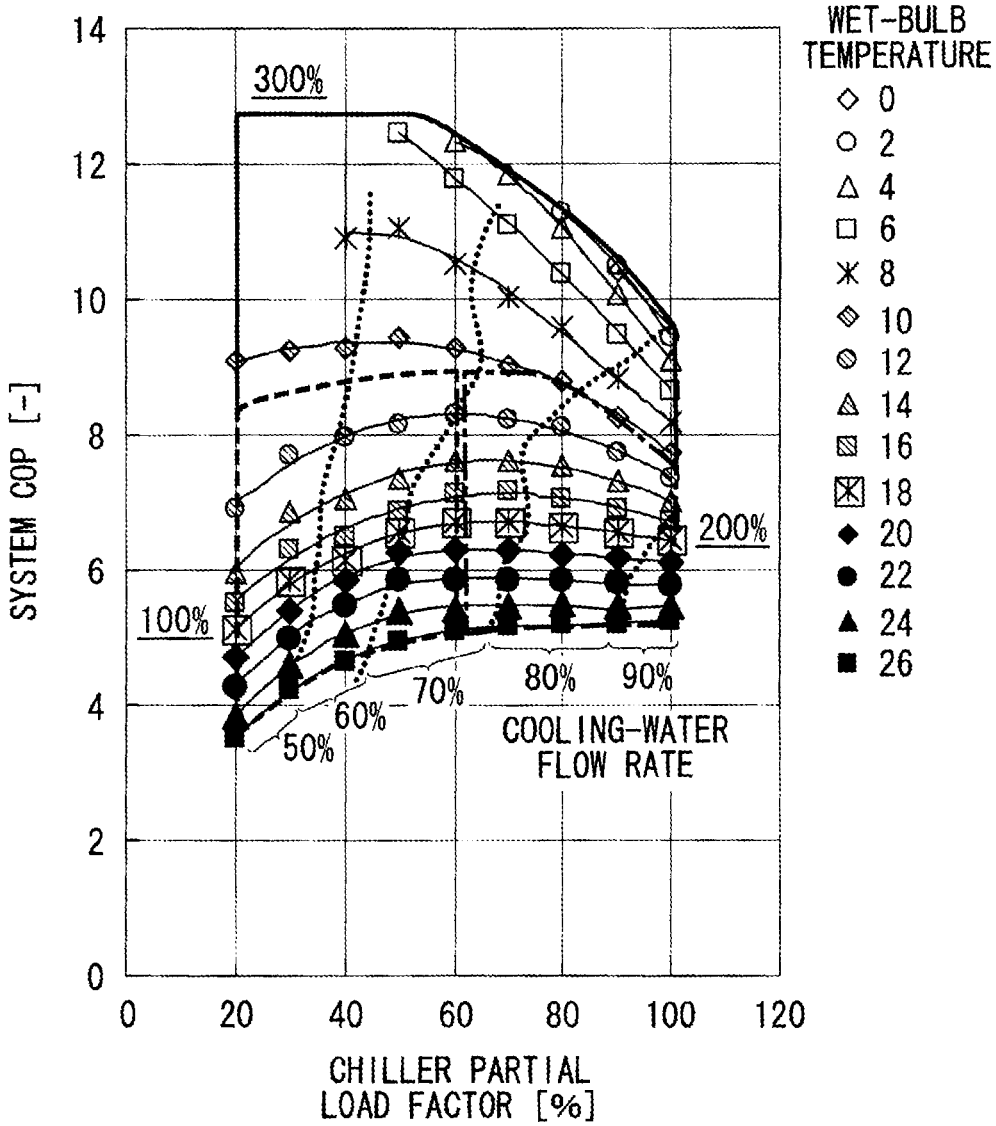
FIG. 10 is a graph of simulation results of the system COP when increase in the cooling-tower capacity and reduction in the cooling-water flow rate are combined, versus the centrifugal-chiller partial load factor.

FIG. 10 shows simulation results of the system COP, which shows the efficiency of the heat-source system, when the cooling-tower capacity is increased and the cooling-water flow rate is reduced. In the figure, the horizontal axis represents the centrifugal-chiller partial load factor. The results are plotted for respective outside-air wet-bulb temperatures. The solid lines show points at which the maximum system COP occurs. Furthermore, the dotted lines define regions of the cooling-water flow rate where the maximum system COP occurs. In addition, similarly to FIG. 7, regions of the cooling-tower capacity where the maximum system COP occurs are shown.

When the specified rated cooling-water inlet-outlet temperature difference is 5° C., the cooling-water flow rate at which the maximum system COP occurs decreases as the centrifugal-chiller partial load factor decreases. At the minimum centrifugal-chiller partial load factor, 20%, the cooling-water flow rate is the minimum, 50%. This is the same tendency as FIG. 9, and it can be understood that the influence of an increase in the cooling-tower capacity on the optimum cooling-water flow rate is small. Accordingly, as shown in the flowchart in FIG. 4, it is appropriate that the cooling-water flow rate is calculated (step S5), independently of an increase in the number of cooling towers (step S7).

Furthermore, comparing FIG. 7 with FIG. 10, it can be seen that the system COP is increased. Accordingly, by combining an increase in the cooling-tower capacity and a reduction in the cooling-water flow rate, the efficiency of the overall heat-source system can be improved.

Figure 4:
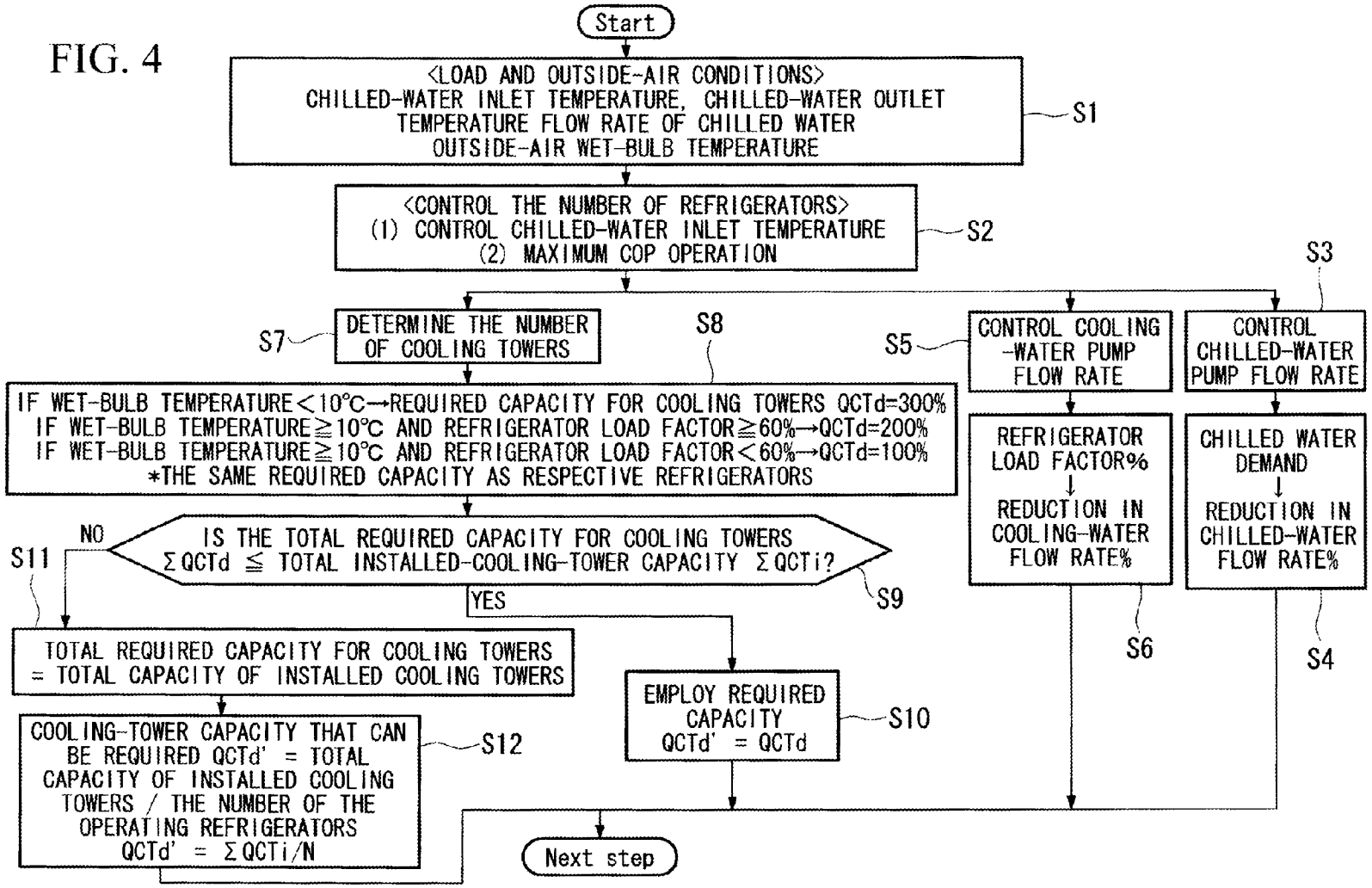
FIG. 4 is a flowchart showing a method for controlling the heat-source system according to an embodiment of the present invention.

Using the simulation results above, the combination of the outside-air wet-bulb temperature and the centrifugal-chiller partial load factor at which the maximum system COP occurs is obtained in advance as the map (optimum cooling-tower capacity relationship) shown in FIG. 2, and, according to this map, the number of cooling towers to be activated is determined according to steps S7 to S12 shown in FIG. 4.

Also regarding reduction in the cooling-water flow rate, using the simulation results above, the cooling-water flow rate at which the maximum system COP occurs is obtained in advance as a relational expression shown in FIG. 3, in relation to the centrifugal-chiller partial load factor. Then, according to this, the amount of the cooling water to be reduced is determined according to steps S5 to S6 shown in FIG. 4.

As has been described, the heat-source system 1 and the method for controlling the same according to this embodiment provide the following advantages.

It was found that there is a cooling-tower capacity of the cooling towers 5 with which the heat-source system efficiency is maximized, depending on the outside-air wet-bulb temperature and the centrifugal-chiller partial load factor. Thus, a map showing the cooling-tower capacity with which the efficiency of the heat-source system is increased is obtained in advance, in relation to the outside-air wet-bulb temperature and the centrifugal-chiller partial load factor, and operation is performed according to the map. In this way, high-efficiency operation of the overall heat-source system can be realized.

Furthermore, because the number of cooling towers 5 to be operated can be determined simply by obtaining the outside-air wet-bulb temperature and the centrifugal-chiller partial load factor, extremely simple operation control can be realized.

Furthermore, as a result of a study of the cooling-tower capacity with which the efficiency of the heat-source system is increased in relation to the outside wet-bulb temperature and the centrifugal-chiller partial load factor, it was found that the efficiency of the overall heat-source system is increased by determining the number of cooling towers 5 to be operated such that the cooling-tower capacity is 300% (first capacity), which is larger than the rated capacity of the operating centrifugal-chiller, when the outside-air wet-bulb temperature is equal to or lower than the first predetermined temperature (the outside-air wet-bulb temperature indicated by the curve L1 in FIG. 2). Accordingly, high-efficiency operation is realized by performing this operation during the winter period and an intermediate period when the outside-air wet-bulb temperature is low.

Note that, when the cooling-tower capacity is 300%, the efficiency of the overall heat-source system is high, regardless of the centrifugal-chiller partial load factor. Thus, the number of cooling towers to be operated can be determined based only on the outside-air wet-bulb temperature, independently of the centrifugal-chiller partial load factor. Accordingly, simple operation control is realized.

It was found that the efficiency of the overall heat-source system is increased by determining the number of cooling towers to be operated such that the cooling-tower capacity is 100%, which is equal to the rated capacity of the operating centrifugal-chiller 3, when the outside-air wet-bulb temperature is higher than the first predetermined temperature (the outside-air wet-bulb temperature indicated by the curve L1 in FIG. 2) and the centrifugal-chiller partial load factor is equal to or lower than 60% (the predetermined load factor). Accordingly, high-efficiency operation is realized by performing this operation during an intermediate period when the outside-air wet-bulb temperature is relatively high and the quantity of heat required by the external load is small.

It was found that the efficiency of the overall heat-source system is increased by determining the number of cooling towers to be operated such that the cooling-tower capacity is 200%, when the outside-air wet-bulb temperature is equal to or higher than the first predetermined temperature (the outside-air wet-bulb temperature indicated by the curve L1 in FIG. 2) and the centrifugal-chiller partial load factor is equal to or higher than 60% (the predetermined load factor). Accordingly, high-efficiency operation is realized by performing this operation during the summer period when the outside-air wet-bulb temperature is relatively high and the quantity of heat required by the external load is large.

Furthermore, when the outside-air wet-bulb temperature is equal to or higher than the first predetermined temperature, it is only necessary to select the cooling-tower capacity from 200% and 100%, using a centrifugal-chiller partial load factor of 60% as the threshold. Thus, simplified operation control is realized. Furthermore, when the outside-air wet-bulb temperature is equal to or lower than the first predetermined temperature, it is only necessary to select a cooling-tower capacity of 300%. Accordingly, simplified operation control is realized.

As a result of a study of the cooling-water flow rate with respect to the efficiency of the overall heat-source system, it was found that it is not heavily dependent on the outside-air wet-bulb temperature or the number of cooling towers to be operated, but is heavily dependent on the centrifugal-chiller partial load factor. Therefore, the flow rate of the cooling-water pumps 15 is controlled based on the centrifugal-chiller partial load factor, not the outside-air wet-bulb temperature or the number of cooling towers 5 to be operated. Thus, simplified operation control is realized.

Furthermore, by combining this control with the case where the number of cooling towers 5 to be operated is optimized from the standpoint of the efficiency, the heat-source system can be operated at an even higher efficiency.

REFERENCE SIGNS LIST

1 heat-source system
3 centrifugal-chiller
5 cooling tower
7 centrifugal-compressor
9 condenser
11 evaporator
13 electric motor
15 cooling-water pump
17 cooling-water inflow header
19 cooling-water outflow header

21 chilled-water pump
23 chilled-water inflow header
25 chilled-water outflow header
30 cooling-tower fan
32 sprinkler header
34 cooling-water reservoir tank
36 electric motor
38 cooling-water outflow on-off valve
40 cooling-water inflow on-off valve

The invention claimed is:

1. A heat-source system comprising:

a centrifugal-chiller including a centrifugal-compressor driven by electricity and having a variable rotational frequency, the centrifugal-compressor compressing refrigerant, a condenser that condenses the refrigerant compressed by the centrifugal-compressor into liquid, an expansion valve that expands the refrigerant condensed into liquid by the condenser, and an evaporator that evaporates the refrigerant expanded by the expansion valve;

a cooling-water pump driven by electricity that supplies cooling water for cooling the refrigerant by heat exchange in the condenser;

a cooling tower that cools the cooling water guided from the condenser by the cooling-water pump by bringing the cooling water into contact with the outside air to perform heat exchange;

a cooling-tower fan driven by electricity and provided on the cooling tower, the cooling-tower fan introducing the outside air into the cooling tower;

a chilled-water pump driven by electricity that supplies the chilled water cooled by the heat exchange in the evaporator to an external load side;

and a control unit that controls the centrifugal-chiller, the cooling-water pump, the cooling tower, the cooling-tower fan, and the chilled-water pump, wherein a plurality of the centrifugal-chillers are provided, a plurality of the cooling towers are provided so as to have a cooling-tower capacity corresponding to the total capacity of the rated capacities of the respective centrifugal-chillers, the cooling towers being commonly connected to the plurality of centrifugal-chillers, the control unit can change the number of cooling towers to be operated so that the cooling-tower capacity can be changed, the control unit preliminarily stores an optimum cooling-tower capacity relationship representing the cooling-tower capacity of the cooling towers with which the heat-source system efficiency, taking into consideration the centrifugal-chillers, the cooling-water pump, the cooling towers, the cooling-tower fan, and the chilled-water pump, is higher, in relation to the outside-air wet-bulb temperature and the centrifugal-chiller partial load factor, and the control unit determines the number of cooling towers to be operated by referring to the optimum cooling-tower capacity relationship, on the basis of the outside-air wet-bulb temperature and the partial load factor of the centrifugal-chillers during operation.

2. The heat-source system according to claim 1, wherein the control unit determines the number of cooling towers to be operated based on the optimum cooling-tower capacity relationship, such that a first capacity that is larger than the rated capacity of the operating centrifugal-chiller is provided, when the outside-air wet-bulb temperature is equal to or lower than a first predetermined temperature.

3. The heat-source system according to claim 2, wherein the control unit determines the number of cooling towers to be operated such that an equal capacity, which is equal to the rated capacity of the operating centrifugal-chiller, is provided, when the outside-air wet-bulb temperature is higher than a second predetermined temperature and the centrifugal-chiller partial load factor is equal to or lower than a predetermined load factor.

4. The heat-source system according to claim 3, wherein the control unit determines the number of cooling towers to be operated such that a second capacity, which is equal to or lower than the first capacity and is equal to or higher than the equal capacity, is provided, when the outside-air wet-bulb temperature is equal to or higher than the second predetermined temperature and the centrifugal-chiller partial load factor is equal to or higher than the predetermined load factor.

5. The heat-source system according to claim 1 wherein the control unit controls the flow rate of the cooling-water pump based on the centrifugal-chiller partial load factor, regardless of the outside-air wet-bulb temperature or the number of cooling towers to be operated.

6. A method for controlling a heat-source system comprising:

a centrifugal-chiller including a centrifugal-compressor driven by electricity and having a variable rotational frequency, the centrifugal-compressor compressing refrigerant, a condenser that condenses the refrigerant compressed by the centrifugal-compressor into liquid, an expansion valve that expands the refrigerant condensed into liquid by the condenser, and an evaporator that evaporates the refrigerant expanded by the expansion valve;

a cooling-water pump driven by electricity that supplies cooling water for cooling the refrigerant by heat exchange in the condenser;

a cooling tower that cools the cooling water guided from the condenser by the cooling-water pump by bringing the cooling water into contact with the outside air to perform heat exchange;

a cooling-tower fan driven by electricity and provided on the cooling tower, the cooling-tower fan introducing the outside air into the cooling tower;

a chilled-water pump driven by electricity that supplies the chilled water cooled by the heat exchange in the evaporator to an external load side;

and a control unit that controls the centrifugal-chiller, the cooling-water pump, the cooling tower, the cooling-tower fan, and the chilled-water pump, wherein a plurality of the centrifugal-chillers are provided, a plurality of the cooling towers are provided so as to have a cooling-tower capacity corresponding to the total capacity of the rated capacities of the respective centrifugal-chillers, the cooling towers being commonly connected to the plurality of centrifugal-chillers, the control unit can change the number of cooling towers to be operated so that the cooling-tower capacity can be changed, the control unit preliminarily stores an optimum cooling-tower capacity relationship representing the cooling-tower capacity of the cooling towers with which the heat-source system efficiency, taking into consideration the centrifugal-chillers, the cooling-water pump, the cooling towers, the cooling-tower fan, and the chilled-water pump, is higher, in relation to the outside-air wet-bulb temperature and the centrifugal-chiller partial load factor, and the control unit determines the number of cooling towers to be operated by referring to the optimum cooling-tower capacity relationship, on the basis of the outside-air wet-bulb temperature and the partial load factor of the centrifugal-chillers during operation.

* * * * *